US009873368B2

(12) United States Patent
de Weerdt

(10) Patent No.: US 9,873,368 B2
(45) Date of Patent: Jan. 23, 2018

(54) THREE DIMENSIONAL INTERLOCKED FULLERENE LATTICE GO-TUBE TRUSS

(71) Applicant: Simon Andre de Weerdt, Vancouver (CA)

(72) Inventor: Simon Andre de Weerdt, Vancouver (CA)

( * ) Notice: Subject to any disclaimer, the term of this patent is extended or adjusted under 35 U.S.C. 154(b) by 0 days.

(21) Appl. No.: 15/007,194

(22) Filed: Jan. 26, 2016

(65) Prior Publication Data

US 2017/0210274 A1 Jul. 27, 2017

(51) Int. Cl.
*A45D 19/04* (2006.01)
*B60P 7/135* (2006.01)
*F16M 11/22* (2006.01)

(52) U.S. Cl.
CPC ..... *B60P 7/135* (2013.01); *F16M 11/22* (2013.01)

(58) Field of Classification Search
CPC B60P 7/135; B16M 11/22; E04C 3/02; E04C 3/07; E04C 3/08; E04C 3/40; E04C 2003/0421; E04C 2003/0473; F16M 11/22; B01D 53/02; B25H 9/08
USPC ..... 248/127; 52/633, 634, 637
See application file for complete search history.

(56) References Cited

U.S. PATENT DOCUMENTS 8,402,711 B2 * 3/2013 Lusk ..... B25J 9/08 160/236
2006/0286022 A1 * 12/2006 Miyamoto ..... B01D 53/02 423/445 R

* cited by examiner

*Primary Examiner* — Todd M Epps
(74) *Attorney, Agent, or Firm* — Smiths IP

(57) ABSTRACT

Two or three parallel Fullerene Tube lattice structures, each similar to the carbon nanotube are connected by sharing parallel nodes along the length of the tubes, interlocking the tubes in such a way that bending or displacing one tube perpendicular to its axis induces a torsion in that tube and the adjacent one or two tubes. This arrangement provides a three dimensional Fullerene truss with a maximum cross-sectional area available for enclosed transport tubes relative to the total cross-sectional area with a minimal profile while maximizing the strength, stiffness, load bearing and ability to withstand multidirectional and dynamic stresses within this profile. The two or three Fullerene tubes may be further enclosed and interlinked within a single similar tube composed of a similar lattice where each cell may be one, two or more times the size of the primary tube lattice cells supporting thermal management of the inter-tube environment.

4 Claims, 14 Drawing Sheets

THREE DIMENSIONAL INTERLOCKED FULLERENE LATTICE GO-TUBE TRUSS

This Application claims benefit of U.S. Provisional Application No. 62/108,058, filed Jan. 27, 2015.

BACKGROUND OF THE INVENTION

1. Field of the Invention

The present invention relates to a three dimensional weight bearing structure enclosing two or three tubes with a maximum ratio of interior tube cross sectional area to overall cross sectional area, while minimizing overall structure mass and structural profile size to ease integration in a diversity of applications and locations.

The structure needs to have a high transverse load bearing capacity and stiffness to afford long spans. Further benefit is provided if the structure supporting the tubes is itself enclosed efficiently to allow a temperature controlled environment to the transport tubes and it is advantageous for the structure to be partially transparent in case the transport tubes themselves are transparent.

2. Prior Art

Trusses are generally designed as fully constrained and stationary 2 dimensional structures supporting one major load type, resisting a gravitational load, over a distance between supporting points, a span. Most trusses are composed of elements that carry stress along their principal axis as tensile or compressive loads between nodes or points of connection. Engineered structures such as I-beams are designed to resist bending and tubes are designed to carry torsional loads. There are applications such as torsion bar automobile suspensions that use torsional stresses to manage vertical, gravitational loads, translating the vertical force into a torsional stress, but these are considered machines and trusses generally, do not currently use torsional stress to manage vertical loads Three dimensional trusses or frames in use include the space truss formed by connected tetrahedron frames or shapes, Geodetic aircraft frames and the Iso-truss consisting at least in part of straight elements helically wound about a longitudinal axis. Three dimensional trusses are designed to handle multidimensional loads, or to handle a principal load, such as gravity, using a solution outside of the plane formed by the gravitational load over a span.

OBJECTS AND SUMMARY OF THE INVENTION

It is a principal object of this invention to provide a three dimensional structure to support transport tubes between and over spans, allowing greater distances between supports than other methods or designs.

It is a further object of this invention to enclose the tubes within a minimal cross-sectional area and minimal exterior profile, while providing a maximum circular cross-sectional area to each of the transport tubes.

It is another object of this invention to include torsional strength to support greater gravitational and dynamic loads.

It is a further object of this invention to provide a structure with multidimensional support to deal with loads along or across its longitudinal axis and other occasional loads the structure might be subject to beyond gravitational loads.

It is another object of this invention to provide an enclosed and controlled environment for the transport tubes allowing temperature and other control of the transport tube environment when used together with an appropriate means to manage heat energy in this environment.

It is a further object of this design to provide a structure which might carry transparent transport tubes and allow a direct view into and out of such tubes.

It is another object of this invention to provide a truss with a minimum of straight elements continually parallel to the principal axis of the transport tubes so that when travelling within the tubes at sufficient speed the details of the truss structure can be ignored and a traveller may experience a sense that all or most of the structure is functionally transparent.

DESCRIPTION OF THE DRAWINGS

The first 6 figures show a segment of the Go-Tube Truss, shortened for clarity. The first 9 figures are based on the armchair orientation of the fullerene tubes.

FIG. 10: Is a 3d perspective view of 2 Jagged Orientation Interlocked Fullerene Lattice Tubes showing an interlocked node (4) which has 3 opposite pairs of connecting elements for a total of 6 connecting elements.

FIG. 11: Is a 3d perspective view showing three Jagged Orientation Interlocked Fullerene Lattice Tubes with each tube interlocked with the other two tubes and with two interlocked nodes (4) labelled.

FIG. 12: Is a 3d perspective view showing three Jagged Orientation Interlocked Fullerene Lattice Tubes within an outer Jagged Orientation Fullerene Lattice Tube composed of elements roughly twice as long as the inner tubes.

FIG. 13: Is a top view, or view along the principal axis of three Jagged Orientation Interlocked Fullerene Lattice Tubes enclosed in the outer Jagged Orientation Fullerene Lattice Tube, the full Go-Tube Truss.

FIG. 14: Is a front view, perpendicular to the principal axis of the Jagged Orientation Go-Tube Truss.

DETAILED DESCRIPTION OF THE INVENTION

Figure 1:
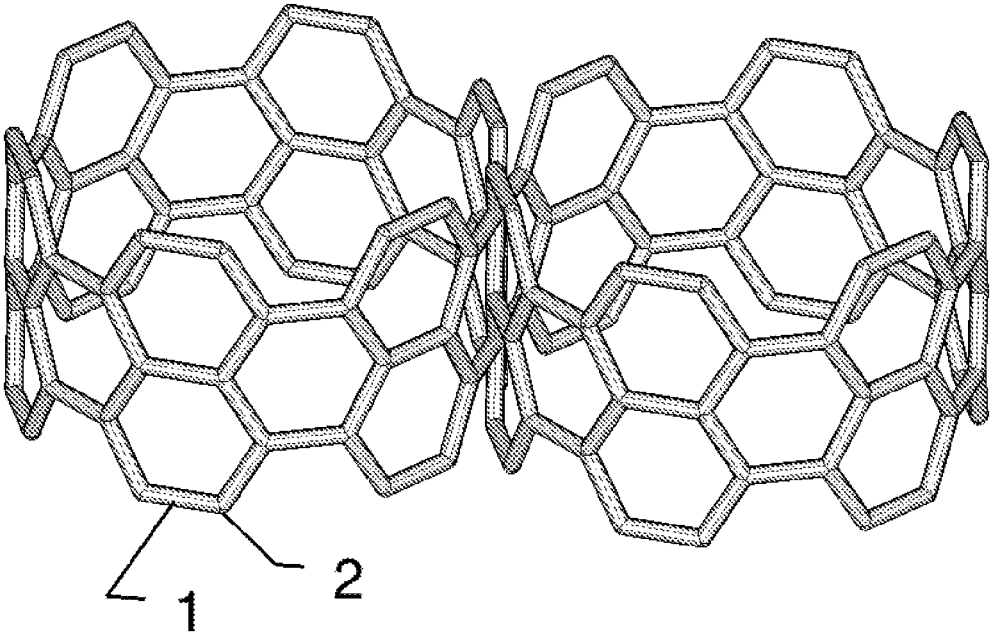
FIG. 1: Is a 3d perspective view of two Interlocked Fullerene Lattice Tubes consisting of connecting elements (1) and nodes (2).
Figure 2:
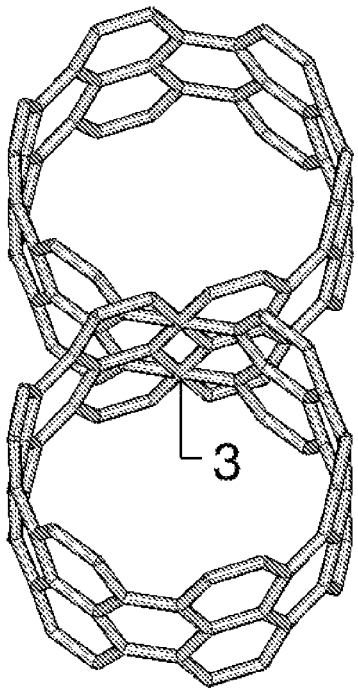
FIG. 2: Is a 3d perspective view of two Interlocked Fullerene Lattice Tubes showing the interlocked nodes (3) which have 3 opposite pairs of connecting elements for a total of 6 connecting elements each.
Figure 3:
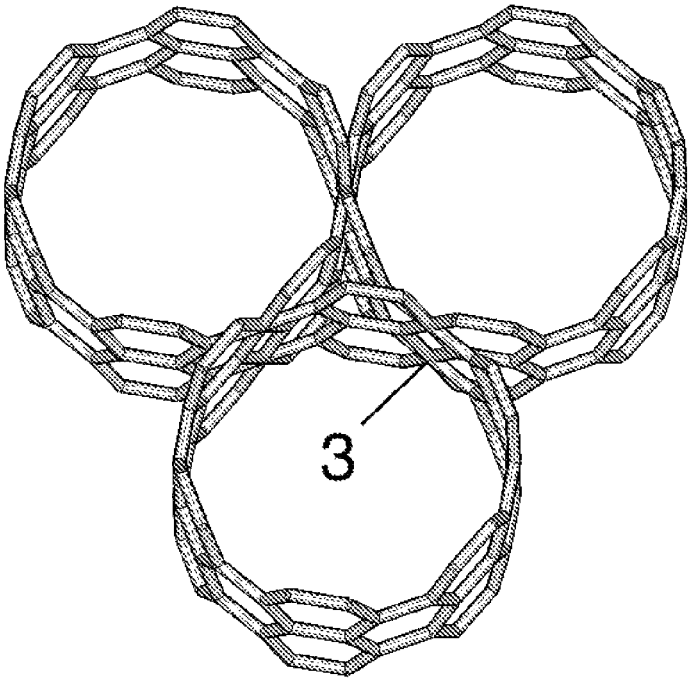
FIG. 3: Is a 3d perspective view showing three interlocked Fullerene Lattice Tubes with each tube interlocked with the other two tubes and with one interlocked node (3) labelled.
Figure 4:
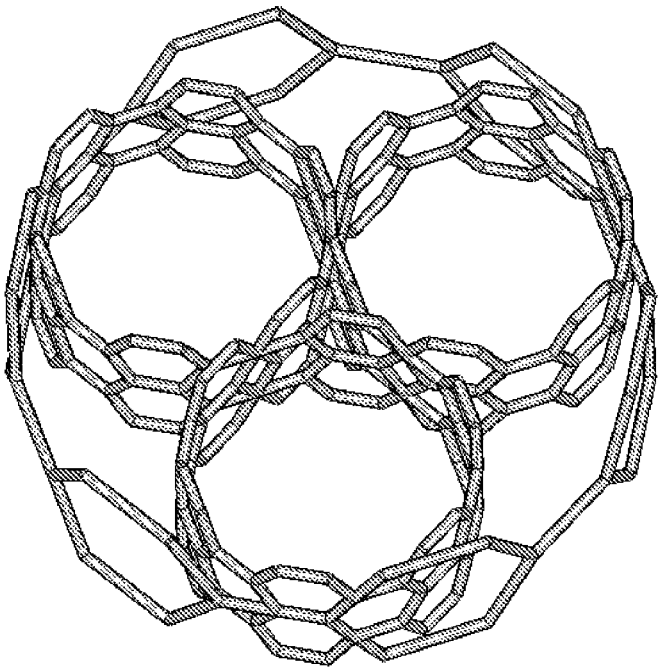
FIG. 4: Is a 3d perspective view showing three Interlocked Fullerene Lattice Tubes within an outer Fullerene Lattice Tube composed of elements roughly twice as long as the inner tubes.
Figure 5:
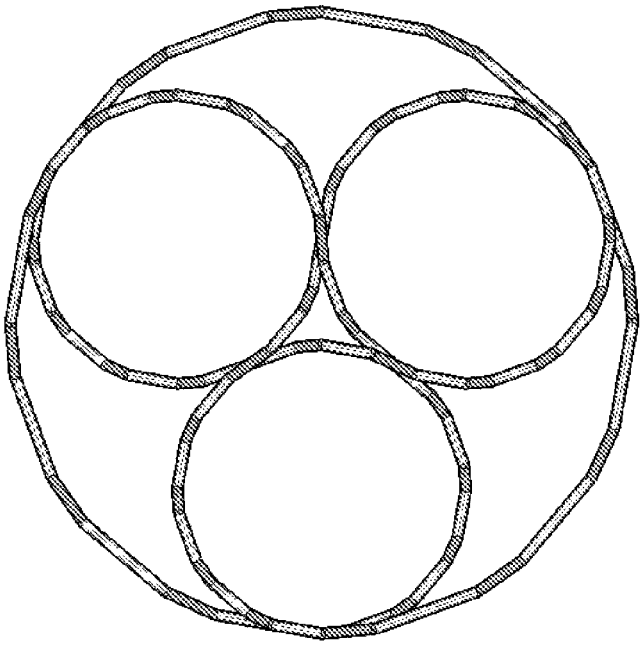
FIG. 5: Is a top view, or view along the principal axis of three Interlocked Fullerene Lattice Tubes enclosed in the outer Fullerene Lattice Tube, the full Go-Tube Truss.
Figure 6:
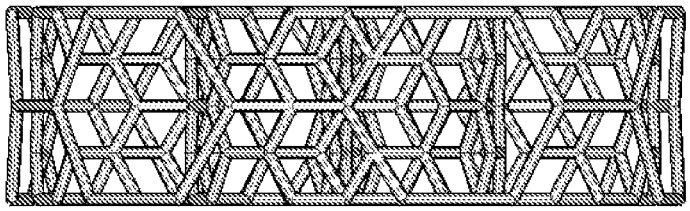
FIG. 6: Is a front view, perpendicular to the principal axis of the Armchair Orientation Go-Tube Truss.
Figure 7:
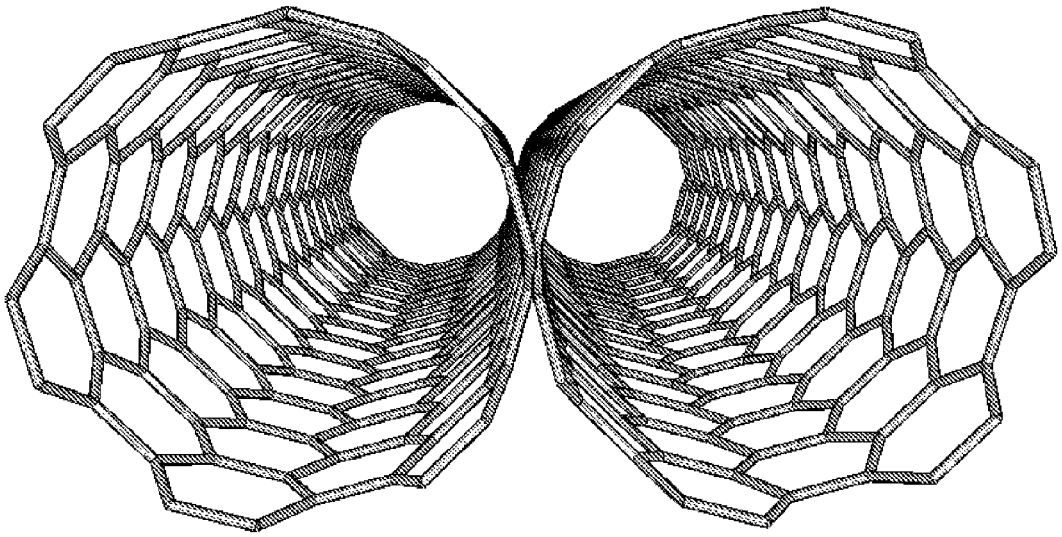
FIG. 7: Is a 3d perspective view of a longer section of two Interlocked Fullerene Lattice Tubes looking along the axis.
Figure 8:
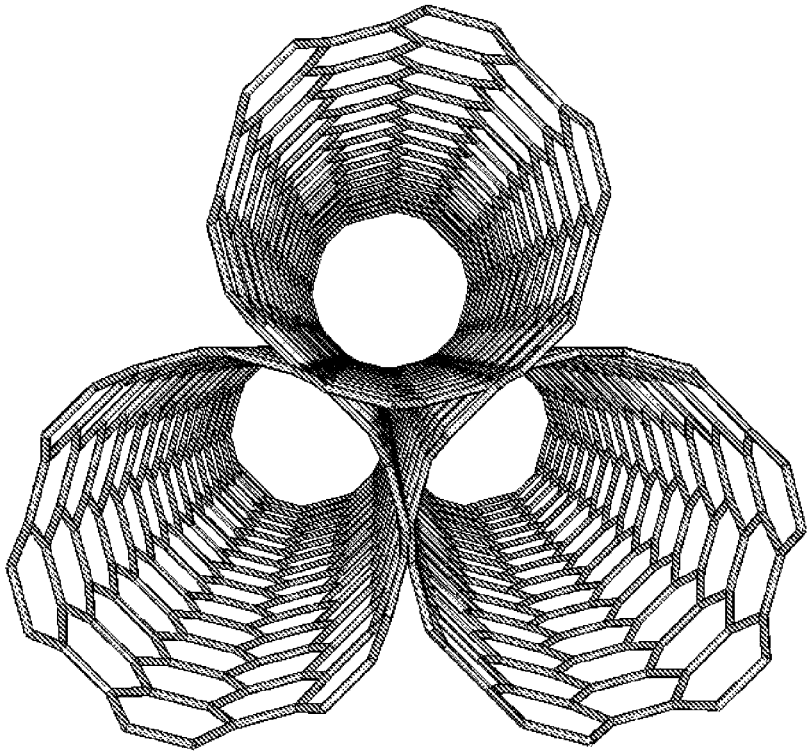
FIG. 8: Is a 3d perspective view of a longer section of three Interlocked Fullerene Lattice Tubes looking along the axis.
Figure 9:
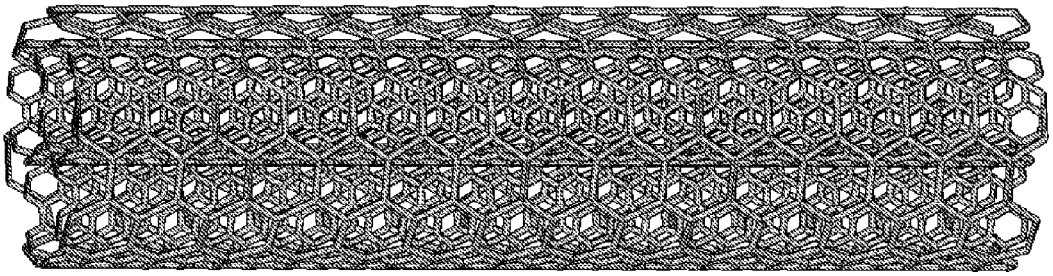
FIG. 9: Is a 3d perspective view of a longer section of three Interlocked Fullerene Lattice Tubes enclosed within an outer Fullerene Lattice Tube viewed roughly perpendicular to the main axis.
Figure 10:
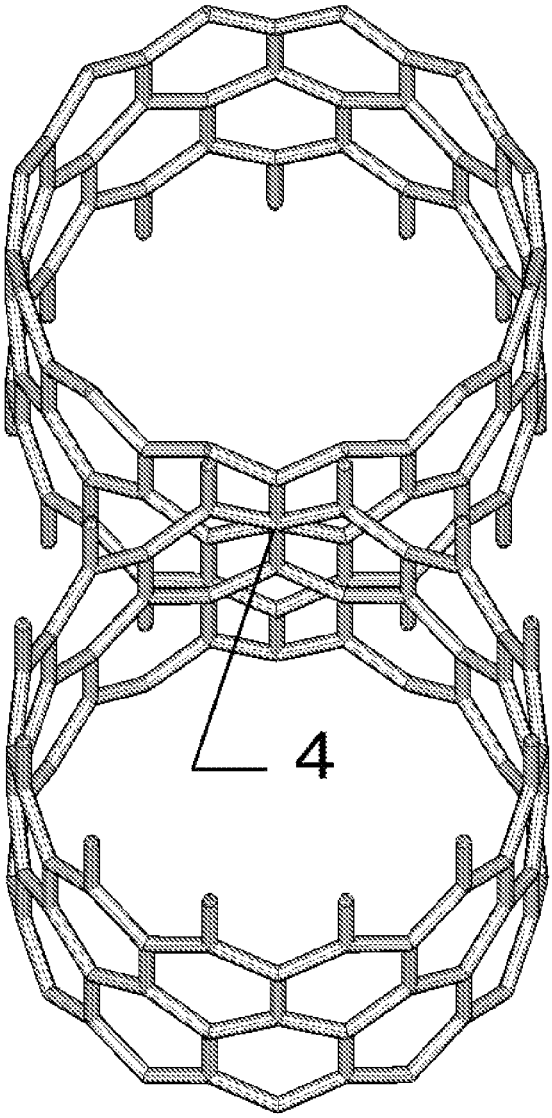
FIGS. 10 through 14 show the variation with the jagged orientation of fullerene tubes.
Figure 11:
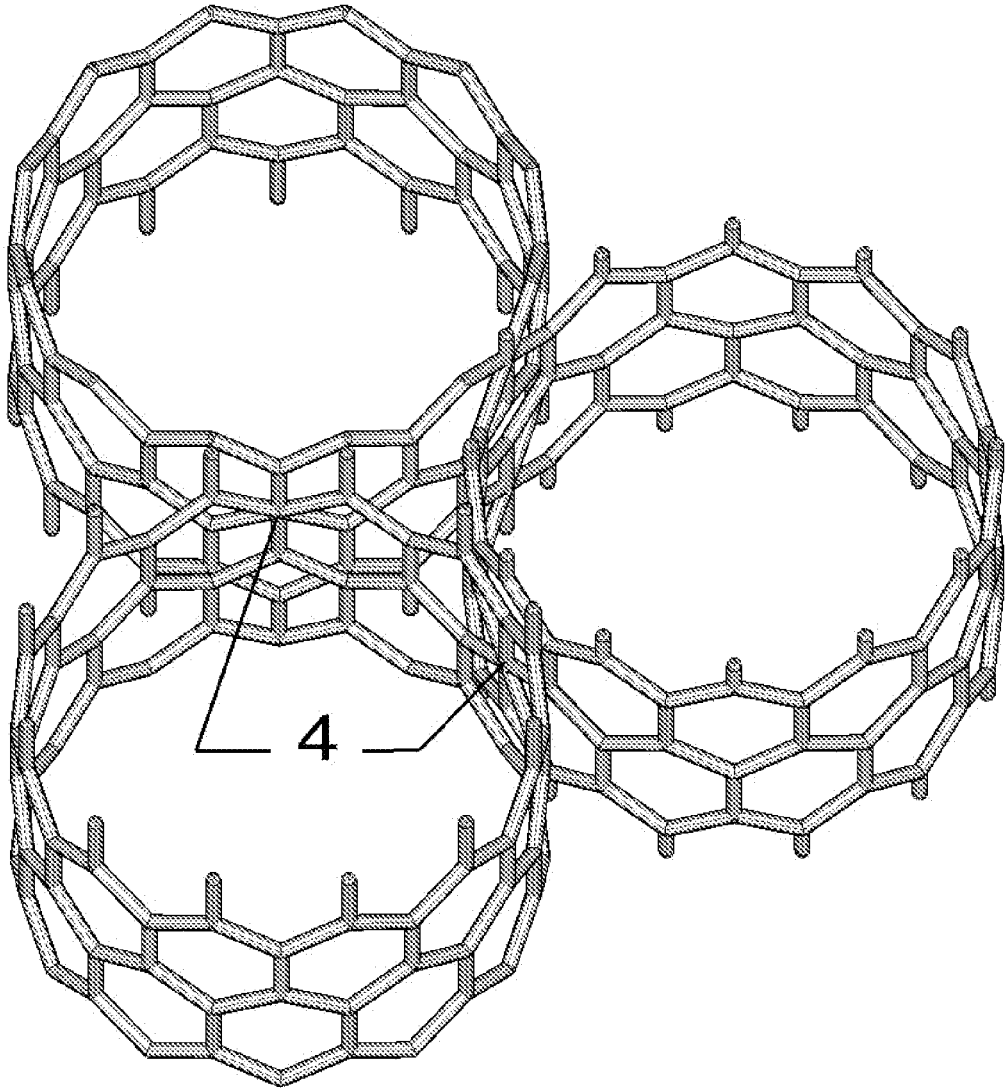
Figure 12:
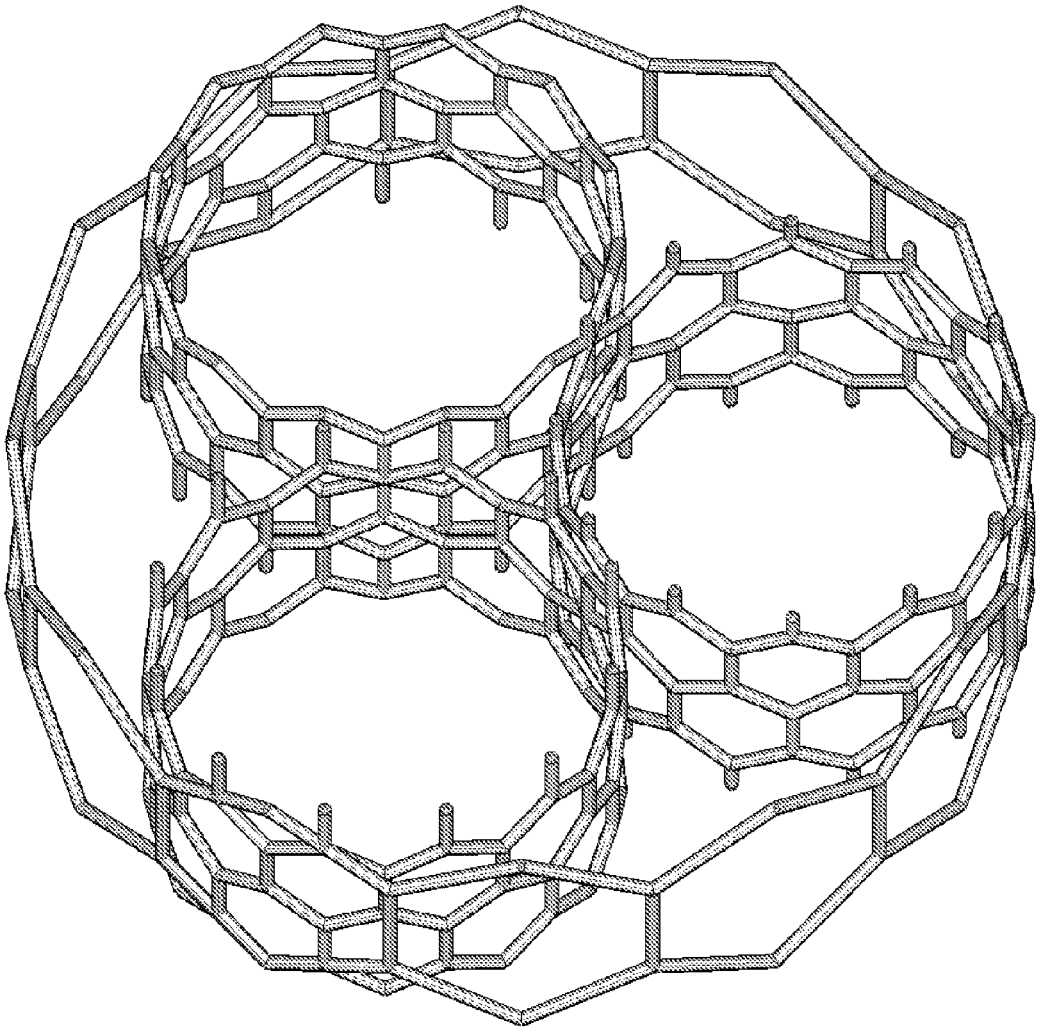
Figure 13:
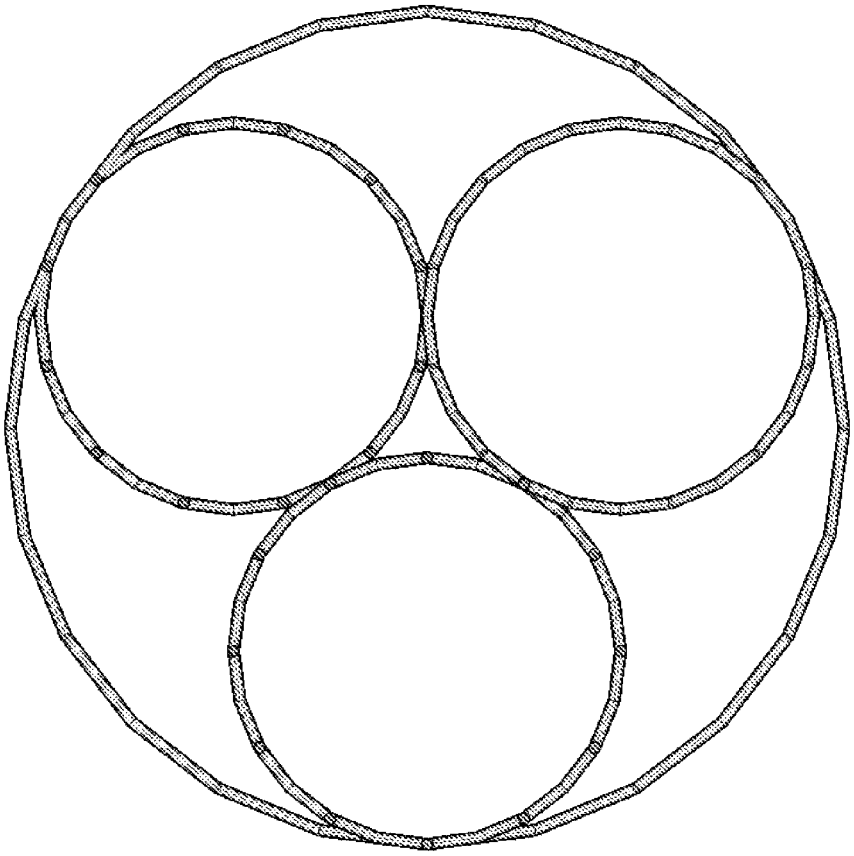
Figure 14:
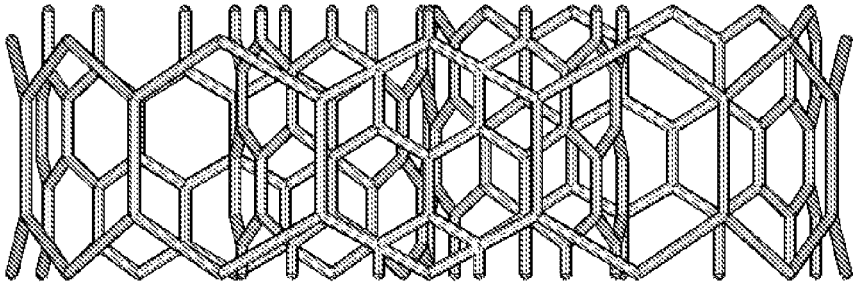

Three tubes, whose walls are composed of a hexagonal fullerene lattice of connected elements, as is the carbon nanotube, are interlocked by sharing one line of parallel common elements with each of the other two tubes. Shear forces, such as a weight or load perpendicular to the three tube axis is assumed as a torsional load on each of the three tubes due to the tangential links at the shared points of connection. This results is a substantial increase in load bearing efficiency, perpendicular to the axis. The forces in the connected fullerene lattice will be largely tension forces, further, if each of the three tubes closely or firmly encloses tubes with efficient compressive strength, failure by buckling will be reduced. The three interlinked tubes may be enclosed by a similar hexagonal fullerene tube lattice, with links one, two or more times the size of the links of the three primary tubes. The enclosure provides some increase in strength and allows environmental control, especially temperature control of the inner tubes.

There are three iso-forms for these hexagonal fullerene tubes, known as the armchair, jagged or chiral form. If we cut the tube perpendicular to its axis, the armchair form will have links between elements parallel to the cut, the jagged form will have symmetrical jagged links plus or minus 30 degrees from the cut, the chiral form has elements 15 and 45 degrees or otherwise from the cut. The armchair and jagged forms repeat radially and the chiral form hexagons spiral around their principal axis.

If the tube is in the "armchair" arrangement, then a nodal element is shared between adjacent tubes and each of the shared nodes has 6 opposing links connecting from or through it. If identical fullerene tubes are prepared with the armchair arrangement then the tubes are mirrored about the principal axis. Its as if one could stack columns up pushing the nodes together such that 3 opposing pairs of elements are joined along one line of points parallel to the principal axis.

In the case of the "jagged" form one tube may be aligned with its jagged points, then the next is aligned ½ hexagon length (measured from point to opposite point) further or shorter along the principal axis than the first and the third is aligned ¼ hexagon shorter than the first. The two or three tubes may be rotated until nodes align with 3 opposing pairs of members. The Jagged form includes one opposing pair parallel to the principal axis.

PATENTS REFERENCED

U.S. Pat. No. 2,511,979 R. H. Goddard Vacuum Tube Transportation System Jun. 20, 1950

U.S. Pat. No. 3,354,591 A Richard BuckminsterFuller Octahedral Building Truss Dec. 7, 1964

U.S. Pat. No. 4,137,354 James T. Mayes, Jr., Will A. Rosene Ribbed composite structure and process and apparatus for producing the same Jan. 30, 1979

U.S. Pat. No. 5,950,543 Daryl Oster Evacuated tube transport Sep. 14, 1999

U.S. Pat. No. 5,921,048 Larry R. Francom & David E. Jensen Three Dimensional Iso-Truss Structure Jul. 13, 1999

The invention claimed is:

1. A three dimensional Fullerene truss structure comprising two or three interlocked inner tube structures enclosed within an outer tube structure wherein:

each of said inner tube structures and said outer tube structure consists of hexagonal links mimicking a carbon nanotube;

each of said inner tube structures surrounds and supports a continuous reduced-pressure transportation tube used for transporting capsules or vehicles at high speed;

said inner tube structures are joined at nodes by three pairs of directly opposing link elements, thereby passing torsion forces from one of said inner tube structures to an adjoined one of said inner tube structures and facilitating a conversion of transverse gravitational loads into torsional or rotational loads;

a size of said hexagonal links forming said outer tube structure is one, two or more multiples of a size of said hexagonal links forming said inner tube structures with slight variations to ensure that said links are aligned.

2. The truss structure of claim 1, wherein said outer tube is covered with and enclosed by panels permitting temperature control of said inner tube structures and said transportation tubes allowing substantial reduction or elimination of expansion joints in said transportation tubes.

3. The truss structure of claim 2, wherein said transportation tubes and said panels are transparent or translucent allowing viewing from inside said transportation tubes.

4. The truss structure of claim 2, wherein solar films or panels are integrated within or upon said panels to collect power for temperature control, for motive power and for other uses.

* * * * *